United States Patent [19]

Tomura et al.

[11] Patent Number: 4,833,059

[45] Date of Patent: May 23, 1989

[54] DEVELOPING METHOD USING ONE-COMPONENT NON-MAGNETIC TONER WITH POSITIVE FRICTIONAL CHARGE

[75] Inventors: Shinya Tomura, Yamato; Tetsuo Okuyama, Yokohama; Mitsunaga Saito, Tokyo; Tsutomu Uehara, Yokosuka, all of Japan

[73] Assignee: Kabushiki Kaisha Toshiba, Kawasaki, Japan

[21] Appl. No.: 26,265

[22] Filed: Mar. 16, 1987

[30] Foreign Application Priority Data

| | | | |
|---|---|---|---|
| Mar. 18, 1986 | [JP] | Japan | 61-58351 |
| Mar. 26, 1986 | [JP] | Japan | 61-67512 |
| Sep. 29, 1986 | [JP] | Japan | 61-231015 |

[51] Int. Cl.[4] ..... G03G 15/08

[52] U.S. Cl. ..... 430/120; 355/259

[58] Field of Search ..... 430/120, 138, 109, 124; 355/3 DD

[56] References Cited

U.S. PATENT DOCUMENTS

| | | | |
|---|---|---|---|
| 2,895,847 | 7/1959 | Mayo | 117/17.5 |
| 3,152,012 | 10/1964 | Schaffert | 118/637 |
| 3,731,146 | 5/1973 | Bettiga et al. | 317/3 |
| 3,909,258 | 9/1975 | Kotz | 96/1 R |
| 4,121,931 | 10/1978 | Nelson | 96/1 SD |
| 4,345,015 | 8/1982 | Hendriksma et al. | 430/111 |
| 4,486,559 | 12/1984 | Murata et al. | 430/109 |
| 4,557,991 | 12/1985 | Takagiwa et al. | 430/109 |
| 4,680,245 | 7/1987 | Suematsu et al. | 430/110 |

OTHER PUBLICATIONS

IEEE-IAS-1985-Annual Meeting; M. Hosoya et al., pp. 1485-1490 (1985); "Xerographic Development Using Single-Component Non-Magnetic Toner".

*Primary Examiner*—John L. Goodrow

*Attorney, Agent, or Firm*—Foley & Lardner, Schwartz, Jeffrey, Schwaab, Mack, Blumenthal & Evans

[57] ABSTRACT

A developing method for converting an electrostatic latent image on the surface of an electrostatic latent image holder into a visible image by arranging the electrostatic latent image holder for holding the electrostatic latent image thereon and a toner conveyor for conveying non-magnetic one-component type toner thereon an extremely small space apart from each other; applying the non-magnetic one-component type toner onto the toner conveyor; and transferring the toner to the electrostatic image holder, satisfies the following requirements: the aforesaid developing agent is composed of non-magnetic type toner; the frictional charge quantity relative to the surface of the non-magnetic type toner is +30 100 $\mu$C; and fluidity is 5 g or less in terms of the toner amounting to 20 g but remaining on a 100-mesh sieve after it has been vibrated at a rate of 3,000 V.P.M. and an amplitude of 1 mm for 30 seconds. The non-magnetic one-component type toner may positively charged non-magnetic one-component type toner at least containing resin and a coloring agent, the resin satisfying the following requirements: the glass transition point is over 50° C.; the softening point is within the range of 110° C.-160° C.; and the frictional charge amount relative to the surface area is within the range of 25~150 $\mu C/m^2$. The non-magnetic one-component type toner may be prepared by treating the surface of toner containing binder resin whose glass transition point is over 50° C., and whose softening point is within the range of 110°~160° C., and a coloring agent with a silane coupling agent having an amino group.

According to the above method, development fog and the scattering of the toner are prevented so that a visible image of good quality can be formed.

5 Claims, 3 Drawing Sheets

DEVELOPING METHOD USING ONE-COMPONENT NON-MAGNETIC TONER WITH POSITIVE FRICTIONAL CHARGE

The present application claims priority of Japanese patent application No. 61-58351 filed on Mar. 18, 1986, No. 61-67512 filed on Mar. 26, 1986, and No. 61-231015 filed on Sept. 29, 1986.

FIELD OF THE INVENTION AND RELATED ART STATEMENT

This invention relates to a developing method for converting an electrostatic latent image formed on a photosensitive material or dielectric into a visible image in an electronic photographic or electrostatic recording apparatus.

In an electronic photographic or electrostatic recording apparatus, a two-component type developing method is widely used to convert an electrostatic latent image formed on an electrostatic image holding means composed of a photosensitive material or dielectric into a visible image of good quality.

The two-component type developing method has the aforesaid advantage but the following disadvantages:

(1) Toner receives a frictional charge resulting from the friction between the toner and a carrier but, if the toner is used for a long time, the surface of the carrier is contaminated with the composition of the toner and the carrier will be unable to obtain a sufficient amount of charge;

(2) Although the toner and carriers must be mixed together within a predetermined range of mixing ratio, the mixing ratio will change and not stay within the predetermined range if the toner is used for a long time, whereby an image of good quality is not obtainable; and (3) Iron powder whose surface has been oxidized or glass beads are often used as a carrier. However, the surface of the photosensitive material is damaged by the carriers and its life is shortened;

In consequence, there have been proposed various methods in which one component type toner composed of toner only is used. More specifically, among the proposed developing methods employing the so-called magnetic toner containing magnetic powder, those disclosed in U.S. Pat. Nos. 3,909,258 and 4,121,931 have been put to practical use.

Nothwithstanding, those methods still have the following disadvantages:

(1) It is difficult to electrostatically transfer a developed image on an electrostatic latent image to a support member such as ordinary paper because magnetic toner having a relatively low specific resistance is used. The transfer is unsatisfactory particularly when it is conducted in a humid atmosphere; and (2) Toner in colors other than a dark color is unavailable because the toner contains a large amount of magnetic powder.

Accordingly, there have been proposed developing methods employing one-component type toner containing no magnetic powder which is used in the conventional two-component type developing method, but offering a high specific resistance.

The aforesaid methods include those disclosed in U.S. Pat. Nos. 2,895,847, 3,152,012, Japanese Pat. Nos. 9475/66, 2877/70 and 3624/79 based on the touchdown, impression or jumping method.

Use of the toner employed in the two-component type developing method for the one-component developing method still poses the following problems:

In the first place, the amount of the frictional charge generated is insufficient when the above method is used.

In the one-component developing method generally, the toner relative to a toner conveyer must be charged efficiently in an extremely short time and obtain a charge amount (e.g., about $-0.5$ 15 $\mu$C when a selenium photosensitive drum is used) sufficient to convert an electrostatic latent image formed on a photosensitive drum or dielectric into a visible image in a non-contact state. However, the problem is that the toner cannot be charged enough to carry out the aforesaid image visualization by the friction between the toner used in the conventional two-component type developing method and the toner conveyer. In other words, although time is consumed to charge the toner and the carrier to the extent that the charge amount is sufficient to implement image visualization in the conventional two-component developing method, the frictional charge time consumed to charge the toner and the toner conveyer by friction in the one-component developing method is too short to provide the charge amount necessary for the image visualization.

Secondly, the surface of a toner conveyer must uniformly be covered with an extremely thin toner layer, but such a thin layer is impossible to form with the toner employed in the two-component type developing method. Referring to FIG. 4, a process of forming such a thin layer will be described by way of example. As shown in FIG. 4, an elastic blade 2 is forced to contact a toner conveyer 1 with a pressure of 20 g/cm 500 g/cm. Toner 4 contained in a toner container 3 is conveyed as the toner conveyer 1 rotates and uniformly thinly applied by the elastic blade 2 onto the surface of the toner conveyer 1 and moved to an electrostatic image holder 5 arranged an extremely small space apart from the toner conveyer 1 and then transferred from the electrostatic image holder 5 to a toner image fixing medium such as paper. Accordingly, toner 6 should have high flowability and be solidification resistant. However, the toner in the toner container 3 tends to become solidified while being conveyed as the toner conveyer 1 rotates and the massive toner is not applied to the surface of the toner conveyer 1. Moreover, the toner 4 conveyed by the toner conveyer 1 meets with a high facial pressure because of the contact between the elastic blade 2 and the toner conveyer 1. The problem is that the frictional heat thus generated softens the toner 4 and causes it to stick to the surface of the toner conveyer 1, whereby a thin uniform layer of toner is not formed. As the softening point of the toner is raised, its fixing temperature is also increased to the extent that it is not fit for use in an ordinary copying machine.

Thirdly, since a large part of the toner is composed of resin, a great percentage of resin exists on the surface of the toner. A pigment in general is negatively charged and, particularly in the case of carbon black, it is negatively charged. When the resin negatively charged by the friction with the elastic blade is used as toner to be positively charged, it causes an opposite polarity to be produced by the charge generated on the surface of the toner particle between the toner particles; the toner and the toner conveyer; and the toner and the elastic blade. Consequently, problems such as development fog and the scattering of toner may occur. The aforesaid problems frequently occur particularly when many sheets of copying paper are piled up and therefore the conventional one-component type toner is practically unusable in a copying machine. In the case of color toner, the frictional charge caused between the toner and toner conveyer determines the tribo-potential of the toner. In the technological field in question, because any material known as a charge controlling agent is hardly usable, the polarity of the tribo-potential should be determined using a combination of binder resin and a coloring agent. However, there is still another difficulty about a matter satisfying the characteristics necessary for the developing method and realizing the color required.

In the developing methods of prior art, the advantages of the non-magnetic one-component type toner have not yet been utilized completely. The most difficult problem in existence is how to control the frictional charge.

OBJECT AND SUMMARY OF THE INVENTION

An object of the present invention is to provide a developing method wherein there is used positively charged non-magnetic one-component type toner whose frictional charge quantity distribution is not only sharp but also uniform without causing developing fog and the scattering of toner on the periphery of a latent image edge so as to honestly convert the electrostatic latent image into a visible image of good quality.

Another object of the present invention is to provide a developing method wherein there is used positively charged non-magnetic one-component type toner that can continously be supplied from a toner container onto a toner conveyer and formed into a uniform thin layer of toner on the toner conveyer.

Still another object of the present invention is to provide a developing method wherein there is used positively charged non-magnetic one-component type toner that can be conserved stably.

A further object of the present invention is to provide a developing method wherein there is used positively charged non-magnetic one-component type toner that hardly produces off-setting even though a number of images are developed with fixation readily made.

These and other objects of the invention will become more apparent in the detailed description and examples which follow.

In order to solve the aforesaid problems according to the present invention, a developing method for converting an electrostatic latent image on the surface of an electrostatic latent image holder into a visible image by arranging the electrostatic latent image holder for holding the electrostatic latent image thereon and a toner conveyer for conveying non-magnetic one-component type toner thereon an extremely small space apart from each other; applying the non-magnetic one-component type toner onto the toner conveyer; and transferring the toner to the electrostatic image holder, satisfies the following requirements: the aforesaid developing agent is composed of non-magnetic type toner; the frictional charge quantity relative to the surface of the non-magnetic type toner is $+30\sim100$ $\mu$C; and fluidity is 5 g or less in terms of the toner amounting to 20 g but remaining on a 100-mesh sieve after it has been vibrated at a rate of 3,000 V.P.M. and an amplitude of 1 mm for 30 seconds.

The 'frictional charge quantity relative to the surface area' in this case means the value obtained by crushing and dividing the toner into particles ranging in diameter from 5 to 25 $\mu$m, 50% of which are $9\sim15$ $\mu$m in average diameter by % weight, and mixing the toner thus processed with 3 weight % of oxidized iron powder (TEF-V of Nihon Teppun) as a carrier, placing the mixture on a 400-mesh conductive net, with an $N_2$ gas with a pressure of 1 kg/cm$^2$, the charged amount being measured by means of blow-off method (using TB-200 of Toshiba Chemical K.K.), and dividing the charged amount by the surface area measured through the BET. According to the BET method, the surface area is measured as follows: 1 g of a specimen is precisely measured first and put into a cell while it is heated to process the specimen beforehand in a atmosphere of an mixed gas of $N_2$/He=30/70. Then the mixed gas is fixed to the specimen by cooling the cell.

The liquid nitrogen is removed and restored to the normal temperature 5 minutes later. At this time, the quantities of $N_2$ gases on the primary and secondary sides are measured by a detector for detecting thermal conductivity to obtain the surface area and divided by the weight of the specimen to obtain the surface area of the toner.

In the case of the 'fluidity', 60, 100 and 200-mesh sieves are piled up and, together with 20 g toner put in them, vibrated at 3,000 V.P.M (number of vibrations per minute) and a 1 mm amplitude for 30 seconds so as to obtain the sum of the toner left on the 60-mesh sieve and what is left on the 100-mesh sieve.

The reason for limiting the frictional charge amount to a range of 30 $\mu$C/m$^2\sim$100 $\mu$C/m$^2$ according to the present invention is attributed to the fact that, if the toner frictional charge amount is less than 30 $\mu$C/m$^2$, the toner may hardly be charged and conveyed by the toner conveyer. If the amount exceeds 100 $\mu$C/m$^2$, on the contrary, the toner will stuck to the toner conveyer so strongly that no image is formed on the electrostatic image holder.

The reason for limiting the toner fluidity to 5 g or less according to the present invention is due to the fact that, if the toner fludity exceeds 5 g., the toner will be solidified and hardly be supplied from the toner container to the toner conveyer continuously.

In a preferred embodiment of the present invention, the non-magnetic one-component type tone contains at least resin whose glass transition point is over 50° C.; softening point 110° C.$\sim$160° C.; and frictional charge amount relative to the surface area $+25\sim150$ $\mu$C/m$^2$ and a coloring agent.

If the glass transition point of the resin used for the positively charged non-magnetic one-component type toner is lower than 50° C., maintenance of stability will be deteriorated and, if it is lower than 110° C., off-setting will be produced or otherwise, if it exceeds 160° C., the toner will not be fixed.

The resin fit for use as such toner should conform, in the frictional charge amount, to $+25\sim150$ $\mu$C/m$^2$, preferably $+50\sim120$ $\mu$C/m$^2$, over 50° C. in the glass transition point and 110° C.$\sim$160° C. in the softening point. The 'softening point' designates a temperature at which a plunger is moved and resin is made to flow out of the die under the following conditions:

Cross sectional area of plunger: 1 cm$^2$
Die (length): 10 mm
Die (diameter):
Application of load: 10 kg f
Preheating: 300 sec
Starting temperature: 100° C.
Temperature rising speed: 2.5° C./min If the frictional charge amount is less than +25 $\mu C/m^2$, the resin is hardly charged and, if it exceeds 150 $\mu C/m^2$, it becomes difficult to form an image on the electrostatic image holder.

If the glass transition point is lower than 50° C., the maintenance of stability is deteriorated, whereas if the softening point is less than 110° C., the off-setting is easily produced. On the contrary, if it exceeds 160° C., the toner is hardly fixed.

Any type of resin may be used provided the aforesaid conditions are satisfied according to the present invention: e.g., polystyrene and its copolymer; polyester and its copolymer; polyethylene and its copolymer; acrylate and methacrylate resin and their copolymers; silicon resin; polypropylene and its copolymer; wax; polyamide resin; and polyurethane resin, independently or in combination.

Of those kinds of resin, the resin most suitable for use in the present invention is a styrene-(meth) acrylamino-methacrylate copolymer whose glass transition point being over 50° C. and softening point being 110°~160° C.

As the acrylic or methacrylic component for use in the synthesis of the aforesaid copolymer, use can be made of all kinds of known acrylic acids and their derivatives and metacrylic acids and their derivatives, including acrylic acids, acrylic acid esters such as methyl acrylate, ethyl acrylate, propyl acrylate, isopropyl acrylate, butyl acrylate, isobutyl acrylate, pentyl acrylate, hexyl acrylate, peptyl acrylate and octyl acrylate; methacrylic acids; and methacrylic acid esters such as methyl methacrylate, ethyl methacrylate, propyl methacrylate, isopropyl methacrylate, butyl methacrylate, isobutyl methacrylate, pentyl methacrylate, hexyl methacrylate, hexyl methacrylate and octyl methacrylate.

As a monomer having an amino group for the synthesis of the aforesaid copolymer, a methacrylic acid derivative represented by a formula as follows is most suitable for use.

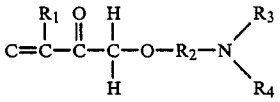

(However, $R_1$, $R_2$, $R_3$, $R_4$ constitute an alkyl group with the number of carbons 1~8)

The monomer having the amino group represented by the above general formula includes, e.g., 2-dimethylamino-2-methylpropyl methacrylate, 2-dimethylamino-2-ethylbutyl methacrylate, 2-dimethylamino-2-propylhexyl methacrylate, 2-diethylamino-2-methylpropyl methacrylate, 2-diethylamino-2-ethylbutyl methacrylate, 2-diethylamino-2-propylhexyl methacrylate, etc.

As for an initiator of polymerization for polymerizing the monomer having the amino group and a styrene-acrylic or styrene-methacrylic copolymer, a nitrile initiator representing azobis (isobutyl nitrile), azobis 2-(2-naphthyl) propyl nitrile, etc. may be used.

In another preferred embodiment of the present invention, the non-magnetic one-component type toner contains at least binder resin as the main component whose glass transition point is higher than 50° C. and softening point ranges from 110° to 160° C. and a coloring agent; and its surface is treated with a silane coupling agent having an amino group.

As the silane coupling agent having a amino group, a silane compound expressed by the following general formula is suitable.

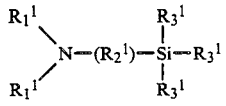

or

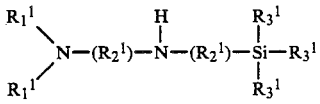

(In the formula, $R_1{}^1$ designates —H, —$CH_3$, —$C_2H_5$, —$CH_2CH_2OH$,

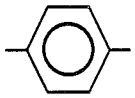

$R_2{}^1$ indicates

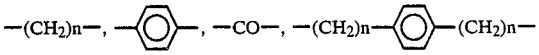

$R_3{}^1$ shows —$CH_3$, —$OCH_3$, —$OC_2H_5$, n representing 1~4 integers)

The silane compound expressed by the above general formula includes:

$H_2N(CH_2)_3Si(OCH_3)_3$,
$H_2N(CH_2)_3Si(OC_2H_5)_3$,
$H_2N(CH_2)_3Si(CH_3)OCH_3)_2$,
$H_2N(CH_2)_3Si(CH_3)_2(OC_2H_5)$,
$H_2N(CH_2)_2NH(CH_2)_3Si(OCH_3)_3$,
$H_2N(CH_2)_2NH(CH_2)_3CH_3Si(OCH_3)_3$,
$H_2N(CH_2)_2NH(CH_2)_3Si(CH_3)(OCH_3)_2$,
$H_2NCO(NH(CH_2)_3Si(OC_2H_5)_3$
$(H_5C_2)_2N(CH_2)_3Si(OCH_3)_3$

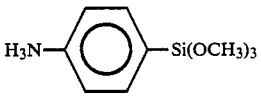

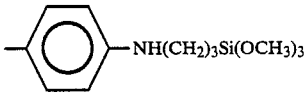

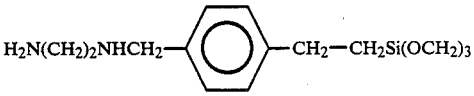

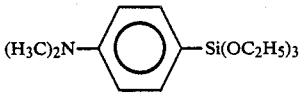

-continued

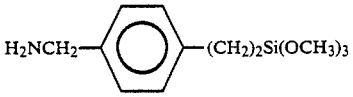

$(HOCH_2CH_2)_2N(CH_2)_3Si(OCH_3)_3$

The silane coupling agent is composed of one or two kinds of components.

A known coloring agent may be used in the present invention, including carbon black, first yellow G, benzine yellow, pigment yellow, indian first, orange, ilgazine red, carmine FB, permanent bordeau FRR, pigment.orange R, resol red 2G, lake red C, rhodamine FB, rhodamine B, lake phthalocyanine blue, pigment blue, brilliant green B, phthalocyanine green, quinacridone, etc.

Wax may be added, if necessary, to the positively charged one-component type toner to improve the offsetting characteristics and further a charge controlling agent may be added to control the frictional charge amount. As the charge controlling agent, use can be made of an amino compound, a 4th grade ammonium compound, an organic dye and its salt, a nigrosine base, a monoazo compound and its metal complex material, polyamine resin, amino resin, etc.

It is also possible to add hydrophobic colloidal fine particles having the same polarity such as colloidal silica to the non-magnetic one-component type toner according the present invention to improve its fluidity and solidification resistance to the extent that the amount added will not affect the charge amount of the toner; e.g., 0.05~5 parts by weight every 100 parts by weight of the toner.

FIG. 1 is a schematic sectional view of an embodiment of the present invention. An elastic blade 12 is pressed against a toner conveyer 11 with a pressure of 20 g/cm~500 g/cm. Toner 14 contained in a toner container 13 is conveyed while the toner conveyer 11 rotates and formed by the elastic blade 12 into an extremely thin layer of toner particles on the surface of the toner conveyer, which are further charged oppositely to the electrostatic charge by the friction between the toner conveyer and the elastic blade. The toner applied to the surface of the toner conveyer is moved to an electrostatic image holder 15 when it gains access to the holder 15 and transferred from the holder 15 to a toner image fixing medium such as paper. The toner allowed to remain on the toner conveyer is recovered to the toner container through the gap between a recovery blade 16 and the toner conveyer 11. Numeral 18 designates an agitator for agitating the toner.

In a developing means, a d.c or a.c. bias or a combination of them generated by superposing one on the other may be applied across the toner conveyer 11 and the electrostatic image holder 15.

As shown in FIG. 2, the frictional charge amount relative to the surface area of the non-mgnetic one-component type toner outside the range of +25~150 $\mu C/m^2$ results in the inferior layer formation or image density reduction and, as shown in FIG. 3, a fluidity exceeding over 5 g also results in the acceleration of the image density reduction.

DETAILED DESCRIPTION OF PREFERRED EMBODIMENT

Figure 1:
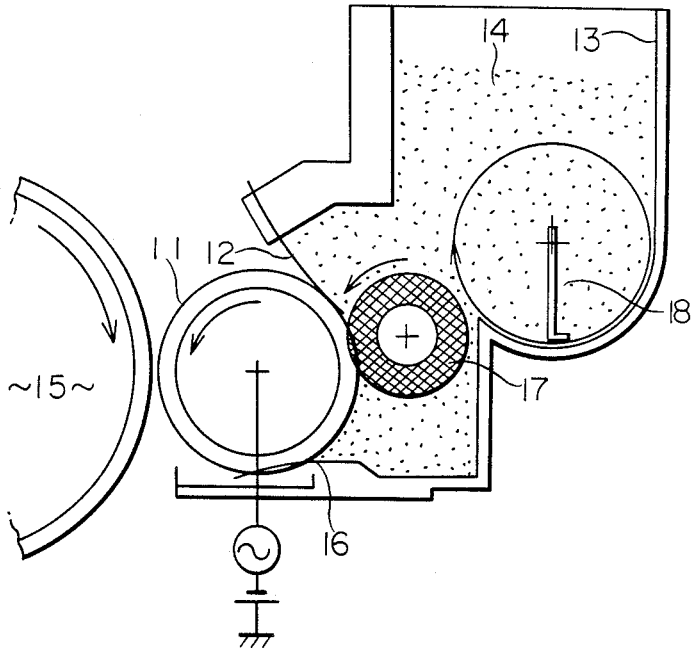
FIG. 1 is a schematic view of a developing apparatus embodying the present invention.
Figure 4:
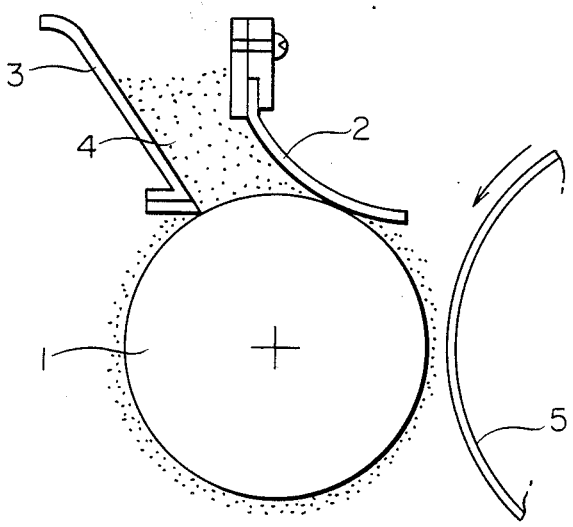
FIG. 4 is a sectional view of a developing apparatus for use in the one-component developing method.
Figure 2:
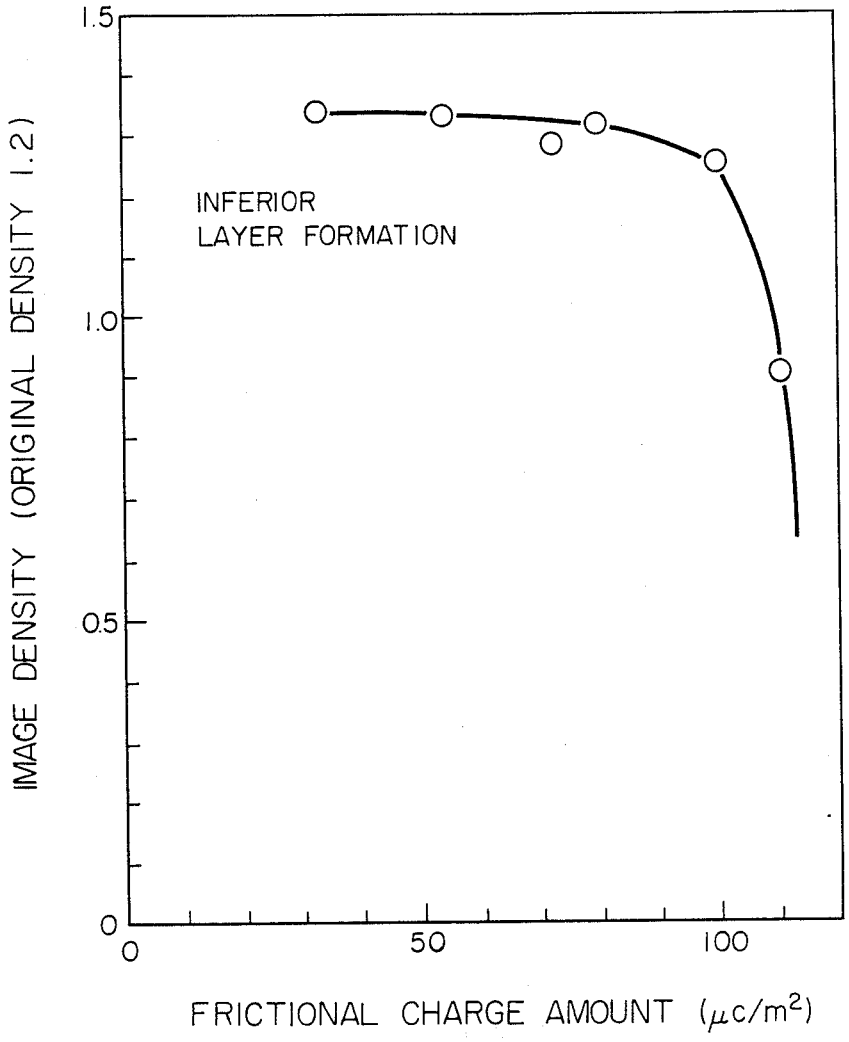
FIG. 2 is a characteristic chart illustrating the relation of the frictional charge amount of a developing agent and an image density.
Figure 3:
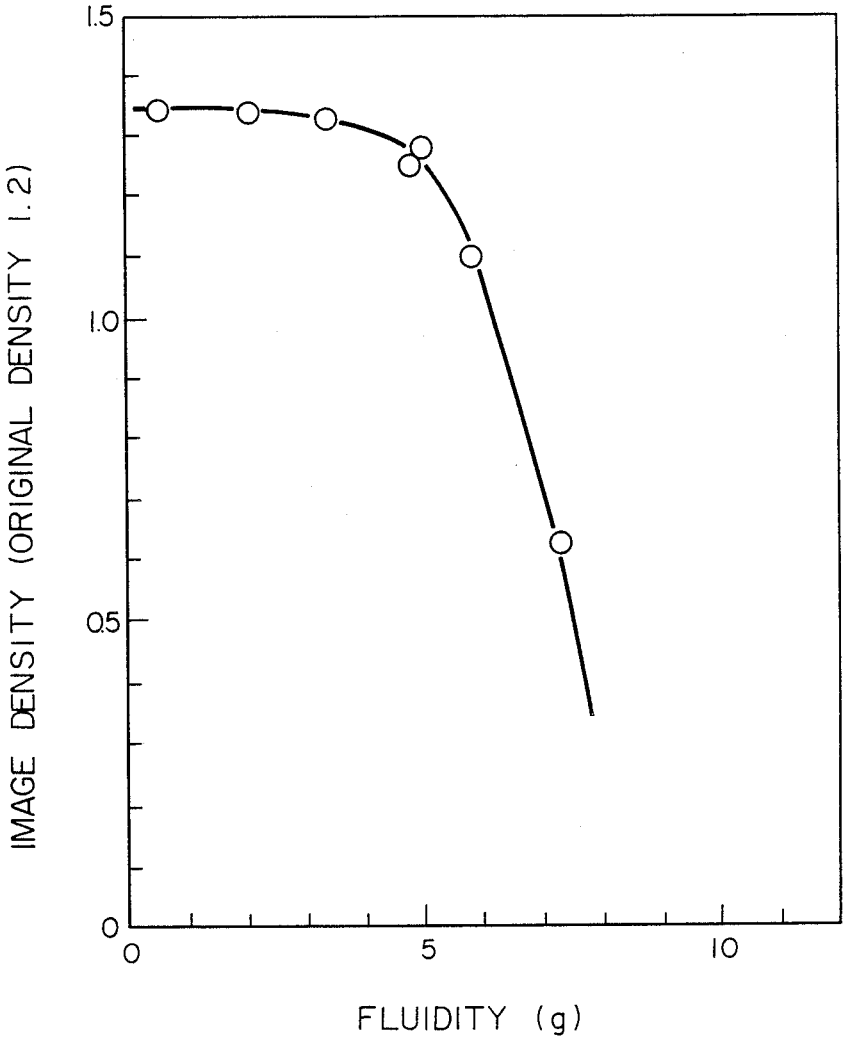
FIG. 3 is a characteristic chart illustrating the relation of the fluidity of the developing agent to the image density.

Embodiments of the present invention will subsequently be described.

In the following examples, parts mean those by weight.

EXAMPLE 1

92 parts of styrene-n-butyl-methacrylate-diethylamino-ethyl-methacrylate copolymer (Tg: 72.0° C., softening point: 122° C., number-average molecular weight: 9,300, weight-average molecular weight: 181,000; and charge amount: 78.5 $\mu C/m^2$), 4 parts of carbon black, 3 parts of wax and 1 part of charge controlling agent (AFP-B of Orient Chemical) were mixed together in a ball mill beforehand for about two hours and kneaded by a pressure kneader for about one hour.

The product thus kneaded was cooled and crushed by a hammer mill roughly and then a jet mill finely. It was then subjected to air classification to obtain 5~25 $\mu m$ toner.

Then 100 parts of the toner and 0.5 part of colloidal fine particles (RP-130: Nippon Aerojil Co.) were mixed together by a ball mill to make the latter stick to the surface of the toner to obtain non-magnetic one-component type toner with 50% weight-average particle size at 12.6 $\mu m$.

The frictional charge amount measured through the toner blow-off method was +53.4 $\mu C/m^2$ with a fluidity of 3.4 g.

Subsequently, the aforesaid tone was used for a copying machine (Rio Dry Model 3301 of Toshiba Corp.) sold on the market and so reconstructed as to mount a negatively charged OPC photosensitive means. A clear image free from development fog was obtained from development in the apparatus shown.

When development was made in a high-temperature, high-humidity atmosphere (30° C., 85% RH) under the same method, a clear image free from development fog and reduction in image density but with a greater transfer efficiency was obtained.

The image fixed using a heat-roll fixing device was seen to offer excellent fixation and off-set within the range of 170° C.-220° C. and images of the same quality were obtained even after 10,000 images were developed.

EXAMPLES 2~5, COMPARATIVE EXAMPLES 1~3

Different types of toner were obtained in the same manner as in the case of the embodiment 1 and their properties were examined under the same conditions as those in the embodiment 1. The table below shows the results obtained.

As shown in the table, polyester was used as a resin for the toner with the charge amount exceeding the upper limit according to the present invention in Comparative Example 1; acrylic resin for the toner with the charge amount exceeding the lower limit according the present invention in Comparative Example 2; and the same resin as that used in the embodiment 1 for the toner with the charge amount exceeding the upper limit according to the present invention in Comparative Example 3. Those types of toner were examined under the same conditions as those in the embodiment 1.

Moreover, a high-density clear image was obtained even in a low-temperature, low-humidity atmosphere (5° C., 10% RH).

When the image thus obtained was fixed using the heat-roll fixing device, the fixation was started at 170° C. and no offsetting was observed even at 220° C.

TABLE

| | Resin | | Toner | | | |
|---|---|---|---|---|---|---|
| Examples | Component | Charge amount ($\mu C/m^2$) | Charge amount ($\mu C/m^2$) | Fluidity (g) | Image density | Remarks |
| Example 2 | styrene-acryl amino methacrylate | 59.6 | 80.1 | 2.1 | 1.33 | |
| Example 3 | styrene-acryl amino methacrylate | 28.5 | 32.2 | 0.69 | 1.34 | |
| Example 4 | styrene-acryl amino methacrylate | 62.3 | 72.5 | 4.9 | 1.28 | |
| Example 5 | styrene-acryl amino methacrylate | 86.1 | 99.5 | 4.8 | 1.25 | |
| Comparative example 1 | polyester | 162.3 | 109.7 | 3.1 | 0.91 | Image density is low. |
| example 2 | acrylic resin | 11.5 | 22.5 | 1.1 | — | Unsatisfactory formation of toner layer on toner conveyer |
| example 3 | styrene-acryl | 178.0 | 120.1 | 7.3 | 0.63 | Image blurry; unsatisfactory supply of toner |

EXAMPLE 6

| | |
|---|---|
| Styrene | 85 parts; |
| n-butyl methacrylate | 10 parts; |
| Di-ethyl amino ethyl methacrylate | 5 parts; |
| Azobis isobutylonitrile | 8 parts. |

The mixture above was agitated at 65° C. for 6 hours to obtain styrene-n butyl methacrylate di-ethyl-amino-ethyl methacrylate resin having the following properties: glass transition point=72.0° C.; softening point=122° C.; number-average molecular weight=9,300; and weight-average molecular weight=181,000. Subsequently, 95 parts of the resin thus obtained, 4 parts of carbon black and 1 part of wax were subjected to preliminary blending using a ball mill for about two hours and then kneaded using a pressure kneader for about one hour. The product thus kneaded was finely crushed by a jet mill and the crushed one was classified through the air classification method so that toner 5~25 $\mu m$ in size was obtained.

Then 100 parts of the toner was blended with 0.5 part of positively charged fine colloidal particles (RA-200 of Nippon Aerosil) using the ball mill to let the toner stick to the surfaces of the fine colloidal particles so as to obtain one-component type magnetic toner 13.2 $\mu m$ in 50% weight-average particle size. The frictional charge amount of the toner measured through the blow-off method was +18.5 $\mu C/m^2$.

The copying machine employed in Example 1 was used to supply the one-component type non-magnetic toner to the apparatus illustrated for developing purposes, whereby a clear image free from development fog was obtained.

When development was made in a high-temperature, high-humidity atmosphere (30° C., 85% RH) under the same method, a clear image free from development fog and reduction in image density but with a greater transfer efficiency was obtained.

EXAMPLE 7

90 parts of bisphenol type polyester having the following properties: number-average molecular weight=4,100; weight-average molecular weight=32,000; and 10 g. of high amine valence styrene-diethyl-amino-methacrylate resin with number-average molecular weight=30,000 and weight-average molecular weight=60,000 were kneaded using a tree-roll mill to obtain resin having the following properties: glass transition point=82.5° C.; softening point=135° C.; and frictional charge amount=87.5 $\mu C/m^2$.

When the same process as that employed in Example 1 was applied, except that 95 parts of the resin thus prepared was used in place of styrene-n-butyl-methacrylate-di-ethyl amino-methacrylate, no development fog was observed and a clear image without the toner scattered around the edge of the electrostatic latent image was obtained.

The 50% weight-average particle size of that toner was 12.3 $\mu m$, whereas its frictional charge amount was +31.5 $\mu C/m^2$.

EXAMPLE 8

95 parts of styrene-n-butyl-methacrylate resin (number-average molecular weight=16,300; weight-average molecular weight=32,800; softening point=125° C.; and glass transition point=61.2° C.) and 5 parts of carbon black were mixed using a ball mill for about two hours and kneaded using a pressure kneader for about one hour. The product thus kneaded was cooled, roughly crushed using a hammer mill, finely crushed using a jet mill and classified using a sorter to obtain toner 5~25 $\mu m$ in particle size. Its 50% wieght-average particle size was 1.14 $\mu m$. A mixture of 100 parts of the toner thus obtained, 0.2 part of N-$\beta$-(amino ethyl)-$\gamma$-amino propyl-trimethoxilan (coated area=353 $m^2/g$) and 100 parts of water were agitated at normal temperature for five hours, spray-dried at 200° C. in the air and subjected to surface treatment to obtain non-magnetic one-component type toner. The tribo charge of the non-magnetic one-component type toner thus obtained was measured through the blow-off method (of Tosiba Chemical) and the result obtained was 25.3 μC/g.

An OPC photosensitive means conveying a negatively charged latent image was used for a copying machine sold on the market (LEODRY Model No. 3301 of Toshiba Corp) and reconstructed and the aforesaid one-component type non-magnetic toner was supplied to the apparatus illustrated for developing purposes, whereby a clear image free from development fog was obtained.

When development was made in a high-temperature, high-humidity atmosphere (30° C., 85% RH) under the same method, a clear image free from development fog and reduction in image development fog and reduction in image density but with a greater transfer efficiency was obtained.

Moreover, a high-density clear image was obtained even in a low-temperature, low-humidity atmosphere (5° C., 10% RH).

When the image thus obtained was fixed using the heat-roll fixing device, the fixation was started at 170° C. and no offsetting was observed even at 220° C. Furthermore, it offered properties excellent in fluidity and anti-solidification without adding a fluidity improving agent.

On the other hand, the tribo charge of the toner whose surface had not been treated with N-β-(amino ethyl)-γ-amino propyl-trimethoxilan showed fluidity as unsatisfactory as 1.15 μC/g.

EXAMPLE 9

The same process as that in Example 1 was executed, except that bisphenol type polyester resin (number-average molecular weight=4,100; weight-average molecular weight=32,000; softening point=135° C.; and glass transistion point=82.5° C.) in place of styrene-n-butyl-methacrylate was used. A clear image without the toner scattered around the edge of the latent image was obtained. The 50% average-weight particle size of the toner was 12.4 μm, whereas the tribo-charge was +21.2 μC/g.

EXAMPLE 10

The same process as that in Example was executed, except that cyanin blue-G-500N (of Sanyo Pigment) instead of carbon black in the case of Example 1 was used. A favorable visible image free from development fog was obtained. The 50% average-weight particle size was 12.0 μm, whereas tribo-charge was +22.8 μC/g.

In the developing method thus devised according to the present invention, the frictional charge amount across the toner and the elastic blade or the toner and the toner conveyer is stabilized and controllable in such a manner as to make it suitable for the developing system in use. In consequence, the possible problems attributed to development fog and the toner scattered around the edge of the latent image can now be solved, whereby a high image density is available.

In case toner is continuously used for a long period of time, the initial properties can be maintained and images of high quality can be supplied for a long time. Moreover the frictional charge amount of the toner is stable even though it is used in an high-temperature high-humidity or low-temperature low-humidity atmosphere. In addition, the toner according to the present invention is almost nearly unaffected in an atmosphere at normal temperatures and humidity and free from not only development fog but also reduction in image density. Moreover, it provides development faithful to a latent image with high transfer efficiency.

What is claimed is:

1. A developing method for converting an electrostatic latent image on the surface of an electrostatic latent image holder into a visible image, comprising the steps of:

arranging the electrostatic latent image holder for holding the electrostatic latent image thereon and a toner conveyer for conveying positively-charged non-magnetic one-component type toner thereon an extremely small space apart from each other;

applying the non-magnetic one-component type toner onto the toner conveyer and contacting the toner with a blade to form a thin layer of toner on the conveyer and frictionally charge the toner; and transferring the toner to the electrostatic latent image holder;

wherein the frictional charge quantity relative to the surface of the non-magnetic type toner is +30~100 mC/m$^2$; and fluidity is not more than 5 g in terms of the toner amounting to 20 g but remaining on a 100-mesh sieve after it has been vibrated at a rate of 3,000 V.P.M. and an amplitude of 1 mm for 30 seconds, and wherein the positively-charged toner contains a resin and a coloring agent, said resin being a styrene-(meth)acrylamino methacrylic copolymer having a glass transition point over 50° C.; a softening point within the range of 110° C.-160° C.; and a frictional charge amount relative to the surface area within the range of 25~150 μC/m$^2$.

2. A developing method as claimed in claim 1, wherein said non-magnetic one-component type toner contains 0.05~5 parts by weight of positively charged colloidal silica.

3. A developing method for converting an electrostatic latent image on the surface of an electrostatic latent image holder into a visible image, comprising the steps of:

arranging the electrostatic latent image holder for holding the electrostatic latent image thereon and a toner conveyer for conveying non-magnetic one-component type toner thereon an extremely small space apart from each other;

applying the non-magnetic one-component type toner onto the toner conveyer; and transferring the toner to the electrostatic image holder, wherein said non-magnetic one-component type toner is prepared by treating the surface of toner containing binder resin whose glass transition point is over 50° C. and whose softening point is within the range of 110°~160° C. and a coloring agent with a silane coupling agent having an amino group, and wherein the frictional charge quantity relative to the surface of the non-magnetic type toner is +30-100 mC/m$^2$; and fluidity is not more than 5 g in terms of the toner amounting to 20 g but remaining on 100-mesh sieve after it has been vibrated at a rate of 3,000 V.P.M. and an amplitude of 1 mm for 30 seconds.

4. A developing method as claimed in claim 3, wherein said silane coupling agent having an amino group is expressed by the following formula:

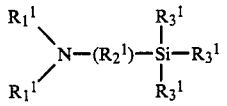
or
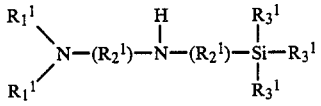
wherein
$R_1^1$ designates —H, —$CH_3$, —$C_2H_5$, —$CH_2CH_2OH$,
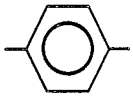
$R_2^1$ designates —$(CH_2)n$—,
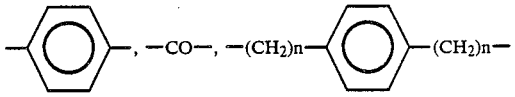
$R_3^1$ designates —$CH_3$, —$OCH_3$, —$OC_2H_5$, and n designates 1∼4 integers.
5. A developing method as claimed in claim 4, wherein said non-magnetic one-component type toner contains 0.05∼5 parts by weight of positively charged colloidal silica.
* * * * *